US005365614A

United States Patent [19]

Perkins

[11] Patent Number: 5,365,614

[45] Date of Patent: Nov. 22, 1994

[54] SPORTS VEST

[75] Inventor: David D. Perkins, Arlington, Vt.

[73] Assignee: The Orvis Company, Inc., Manchester, Vt.

[21] Appl. No.: 35,253

[22] Filed: Mar. 22, 1993

[51] Int. Cl.[5] ..... A41D 27/20; A41D 27/00

[52] U.S. Cl. ..... 2/247; 2/102; 2/250; 2/252; 2/254

[58] Field of Search ..... 2/94, 102, 108, 247, 2/248, 249, 250, 251, 252, 253, 254, 69, 69.5, 114, 115, 113, 49.2, 105, 106, 256, 257, 258, 259

[56] References Cited

U.S. PATENT DOCUMENTS

| | | | |
|---|---|---|---|
| 827,258 | 7/1906 | McCauley | 2/252 |
| 1,086,039 | 2/1914 | Flegle | 2/252 |
| 1,224,842 | 5/1917 | Boyd | 2/252 |
| 3,140,494 | 7/1964 | Magidson | 2/264 |
| 3,266,070 | 8/1966 | O'Link | 2/102 X |

OTHER PUBLICATIONS

P. 38 from Orvis "Fall Hunting and Outdoor 1992" Catalog. vol. XI, No. 1.

Photocopy of glasses case labeled "Side View".

Photocopy of glasses case labeled "End View, Biased Closed".

Photocopy of glasses case labeled "End View Open".

*Primary Examiner*—Jeanette E. Chapman

*Attorney, Agent, or Firm*—Vickers Daniels & Young

[57] ABSTRACT

A garment having an easily opened secure pocket is provided. The pocket has a spring biased closure which will retain pocket contents when the pocket is inverted.

5 Claims, 3 Drawing Sheets

SPORTS VEST

BACKGROUND OF THE INVENTION

The present invention pertains to a sports garment such as a jacket or a vest for use in outdoor environments by hunters, fisherman, birders and others having similar needs. More particularly the invention pertains to an improved pocket structure for a vest or jacket.

Men and women engaged in outdoor activities often need to carry small tools, notepads or other paraphernalia in their pockets. Things that need to be accessed quickly are normally carried in jacket or vest pockets. Over the years, many persons have designed specialized jackets and vests for particular activities. Thus, one can purchase a fishing vest having pockets and attachment points suited to the carrying of fishing accessories. Similarly, hunting jackets are sold having pockets to accommodate hunting equipment. Birders also often buy specialized jackets for carrying field guides, notebooks, binoculars, glasses and the like. Other sporting activities and professional activities have also been the beneficiaries of specialized garments aimed at answering particular needs.

Pockets on vests and jackets are often provided with a securing means. Zippers, buttons and snaps are commonly used. When an expensive or particularly necessary item is carried in a pocket a user will often desire to lock the pocket through the mechanism of a closure. This is particularly the case for a breast pocket. When one is engaged in outdoor activities one often must bend over. Frequently, if one is carrying glasses or other items in a breast pocket and bends over, the items slides out and falls to the ground, sometimes resulting in breakage or loss.

Closure of pockets by buttons, zippers and snaps has presented problems in the past. Buttons can be clumsy and sometimes require the use of two hands to open the pocket and retrieve an item. Zippers and snaps can also be clumsy and are also noisy. In fishing, hunting and birding particularly, it is sometimes necessary to retrieve an item from a pocket quickly, quietly, with one hand and without diverting one's visual attention. In any of these sports, if a fish, animal or bird is spotted, the person involved normally wants to keep undivided visual attention on the wildlife. At the same time, the person may wish to remove a particular accessory or pair of glasses from a pocket. Heretofore, this situation presented problems in that one had to fumble with a button, or forego the use of the glasses. Normally, in this situation, the use of a zipper or snap can destroy the moment by introducing noise into the environment alerting the wildlife to the presence of a person and causing flight.

It is advantageous for a pocket on a sports vest or jacket to be weatherproof. The weatherproof nature of the pocket advantageously includes the closure means. In the past, this has been accomplished with button down flaps. However, as described above, button down flaps can be clumsy and interfere with access to a pocket at a critical moment.

SUMMARY OF THE INVENTION

The present invention contemplates a new and improved pocket structure for a vest or jacket overcoming the above described disadvantages and others.

In accordance with the present invention, there is provided a spring loaded closure mechanism for a pocket which normally holds the pocket closure in the closed configuration but is easily opened by manipulation with a single hand or finger.

Still further in accordance with the invention, a pocket is provided having two normally closed parallel lips forming the top opening of the pocket, the lips being comprised of a fabric covered spring element holding the lips in a generally parallel closed configuration but easily displaced under light pressure to open the pocket top.

Still further in accordance with the invention, the spring element used to close the pocket top is comprised of two linear spring segments each segment contained within one of the pocket top lips.

Yet further in accordance with the invention, the two spring segments are linear springs segments connected at their ends.

Still further in accordance with the invention, the spring segments are metallic elements.

Still further in accordance with the invention, a waterproof flap may be connected to the garment directly above the pocket lips, the flap being normally disposed covering the pocket lips whereby the pocket top is rendered substantially weatherproof.

The principal object of the invention is to provide a pocket for a jacket, vest or the like which is normally held closed but which can be easily and quietly opened and closed with one hand.

It is another object of the present invention to provide a pocket closure mechanism having sufficient force to hold the pocket closed but easily opened by simply inserting something into the pocket opening.

It is still another object of the present invention to provide a pocket closure having sufficient force to retain items within the pocket, such as glasses, even when the pocket is inverted when a wearer bends over, yet which is easily openable with one hand in the upright position.

The invention may take physical form in certain parts and arrangements of parts, a preferred embodiment of which will be described in detail in the specification and illustrated in the accompanying drawings which form a part hereof and wherein.

PREFERRED EMBODIMENT

Figure 1:
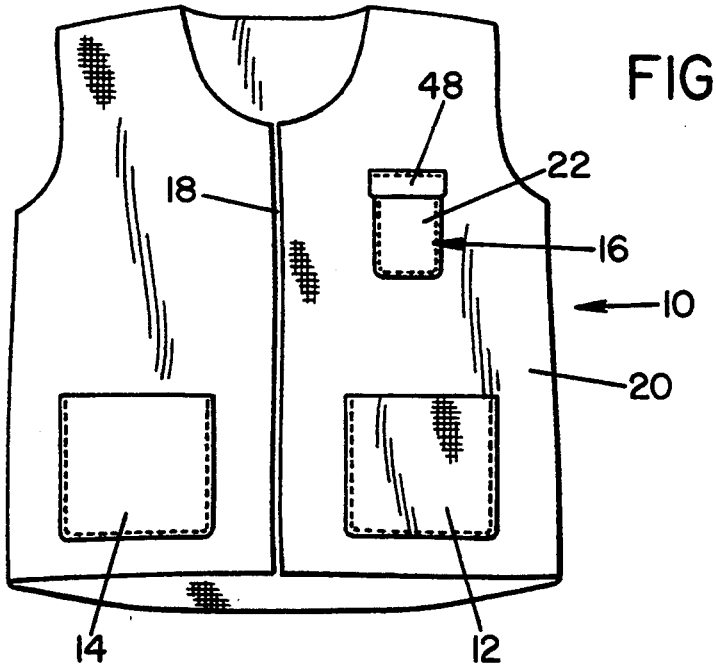
FIG. 1 shows a vest in accordance with the present invention.
Figure 5:
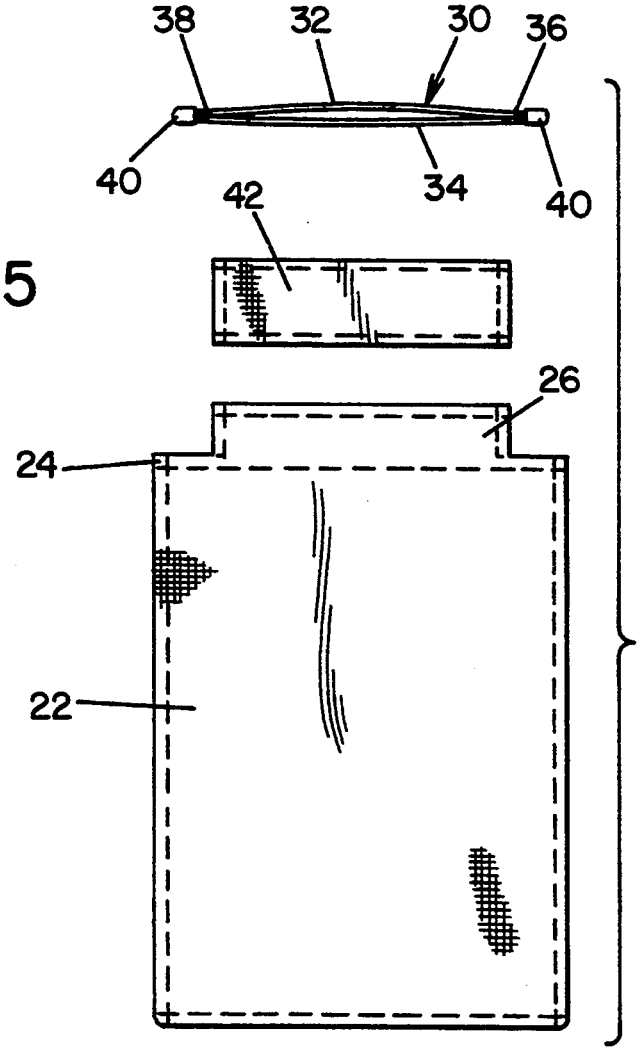
FIG. 5 shows the unassembled parts other than the vest itself needed to construct the invention.
Figure 4:
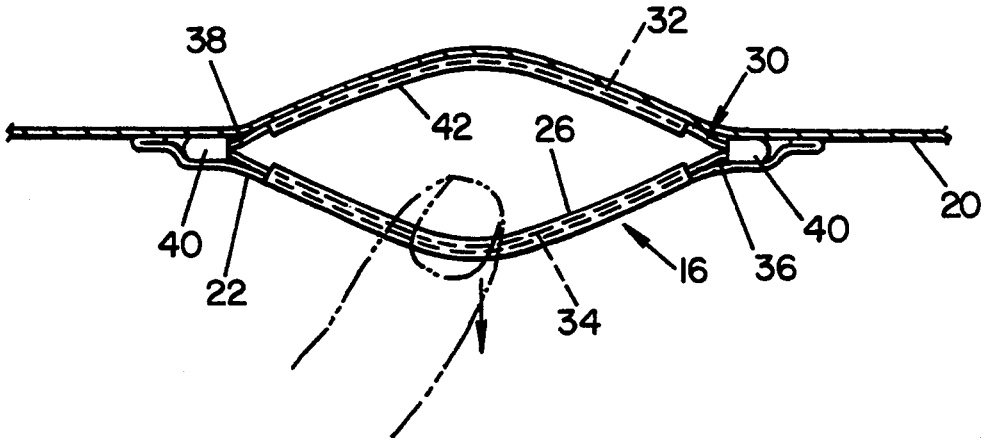
FIG. 4 is a view similar to FIG. 3 showing the top of the pocket in an open configuration.

Referring now to the drawings wherein the showings are for the purposes of illustrating the preferred embodiment of the invention and not for the purpose of limiting same, the figures show a vest 10 having a left hand side pocket 12 a right hand side pocket 14 and a breast pocket 16. The vest is made in accordance with any of the conventional construction techniques which are currently well known. These include insulated vests or jackets, wool vests and jackets and special purpose waterproof vests and jackets. Conventionally, such garments are crafted from any of a variety of fabrics and provided with pockets and other attachment points to aid the user in a particular sport or occupation. For instance, fisherman often wear vests including attachment points for the retention of flies and hooks, pockets adapted to receive reels, attachment points for a creel and the like. Other vests are created for other purposes. Such vests conventionally have a back and a front. The front normally has a split 18 down the center allowing the vest to be donned and taken off. The split is normally closed by snaps, zippers or the like (not shown). The front 20 of the vest 10 forms the attachment points for the pockets 12, 14 and 16. The same construction techniques apply to jackets having sleeves. The invention will be described with respect to a vest, but it is equally applicable to a jacket or coat. The invention will be described with respect to a breast pocket 16 but is equally applicable to other pockets. In fact, one preferred embodiment applies the invention to the left hand side pocket 12 and right hand side pocket 14 only.

Figure 2:
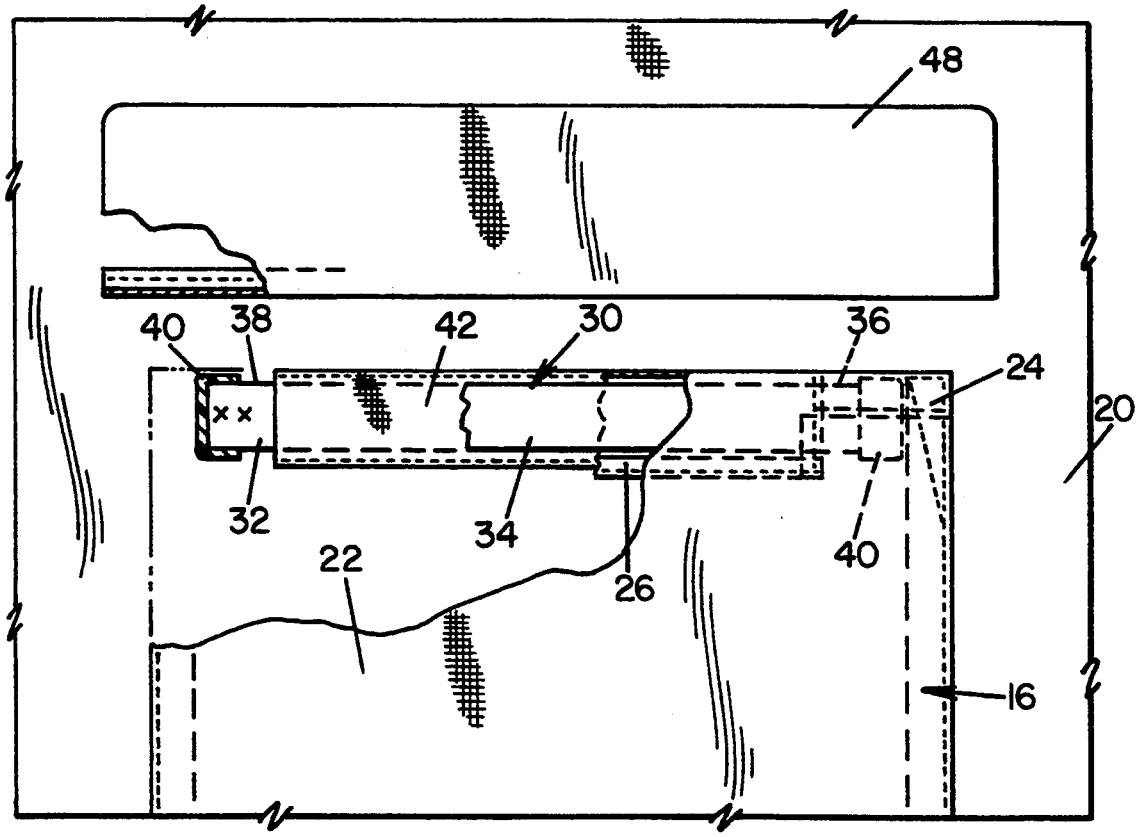
FIG. 2 shows a detail of construction of the breast pocket of the vest of FIG. 1.

The breast pocket 16 is shown in greater detail in FIG. 2. The pocket is formed by either sewing a patch on the front 20 of the vest or by inserting a pouch between the front 20 of the vest and the lining of the front of the vest. While the present invention is applicable to any type of pocket construction, the preferred embodiment will be described with respect to a pocket patch sewn on the front of the vest.

Figure 6:
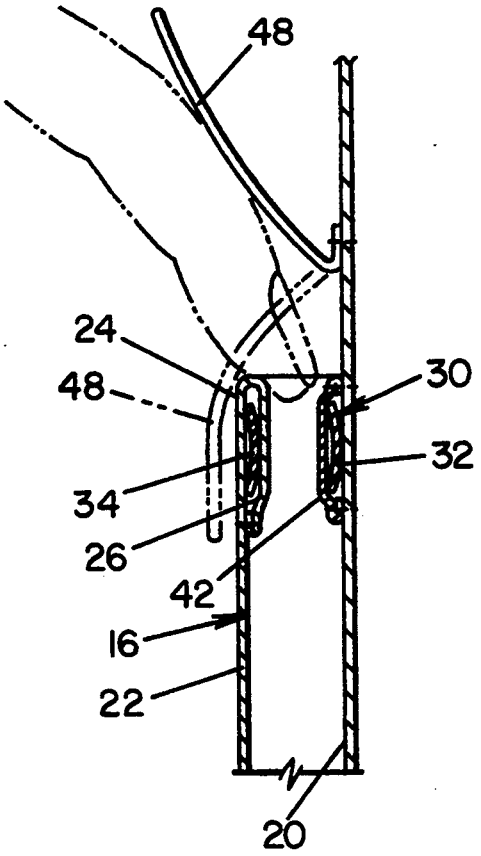
FIG. 6 shows the top of the breast pocket of FIGS. 1–5 in cross-section, partially opened.
Figure 7:
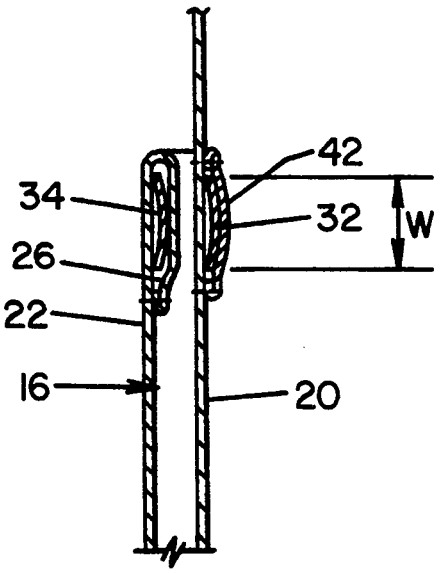
FIG. 7 is a view similar to FIG. 6 showing a modification of the invention in which one of the spring segments is disposed within the front of the vest.

As can be seen in FIG. 2, the body of the pocket 16 is formed by sewing a pocket patch 22 on the front 20 of the vest. The top portion 24 of the pocket patch 22 is provided with a fold over portion 26 which is folded over and sewed to the pocket patch itself capturing a portion of a spring element 30. The spring element 30 is comprised of an inner spring segment 32 and an outer spring segment 34. The two spring segments are slightly longer then the desired length of the opening of the pocket 16. The left hand ends 36 and right hand ends 38 of the spring segments are fixed together by spot welding or the like. The ends 36, 38 can, optionally, be dipped in a resinous material which is allowed to cure and form end caps 40 which protect the vest from cutting by the spring segments. Alternatively, the outer corners of the pocket top may be reinforced by well known techniques. The spring segments 32, 34 can be fabricated from a plastic having proper elastic properties or from spring steel. In the presently preferred embodiment, spring steel is used having characteristics similar to the material used in common metal tape measures. The spring segments 32, 34 have a convex profile in cross-section. Each spring segment has a length and a width wherein at least one segment is convex in cross section through its width as shown in FIG. 7. As best seen in FIGS. 6 and 7, both spring segments 32, 34 bulge at their centers in the same direction. This gives the spring segments a snap action and aids in retention of items within the pocket. This material provides sufficient closing force to hold the pocket 16 closed under normal conditions but is easily deformed by finger pressure to allow easy access to the pocket. Other material including coil springs and stiff plastics, can be substituted as desired.

Figure 3:
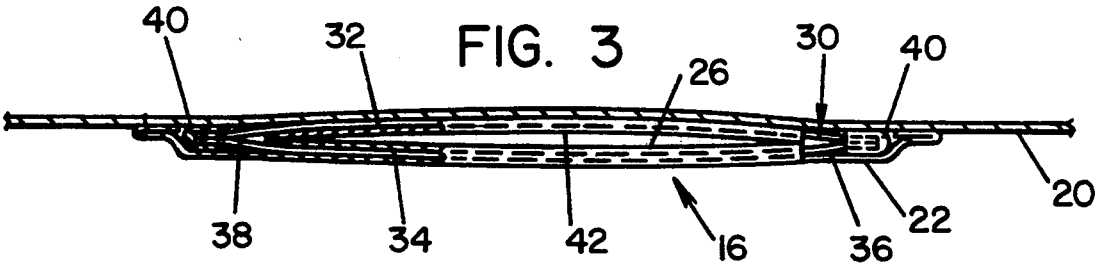
FIG. 3 shows the top of the breast pocket seen in FIGS. 1 and 2 looking downwardly in the almost closed position with the layer spacing exaggerated for clarity.

The inner spring segment 32 is retained on the front 20 of the vest 10 by means of a keeper strip 42 which is sewn along its top and bottom edges to the front 20 of the vest 10. The left hand ends 36 and the right hand ends 38 of the spring segments 32, 34 extend outwardly from behind the keeper strip 42. The left hand ends 36 and the right hand ends 38 are covered by the pocket patch top portion 24. As seen in FIG. 3, the finished construction consists of the pocket patch sewn to the front of the jacket with the spring element fixed within fabric protectors. The two spring segments 32, 34 normally urge the top of the pocket patch 22 against the vest front 20, closing the pocket. One may easily gain access to the pocket by inserting one's finger or another object causing the spring segments 32, 34 to part. The closing force provided by the spring segments 32, 34 is adjusted by selecting spring segments of appropriate size and characteristics.

Some weather protection is provided by the spring mechanism holding the pocket closed. However, in extreme circumstances, additionally weather protection may be provided by a flap 48 which is sewn to the front 20 of the vest 10 just above the pocket patch 22. As seen in FIG. 2, the flap 48 is folded upwardly. In its normal configuration, as seen in FIG. 1, the flap 48 is flat against the vest front 20 and extends downwardly covering the top of the pocket 16. Optionally, the sides of the flap 48 can be sewn to the vest front. Weather protection is thereby provided.

The pocket is assembled in the following steps. The fold over portion 26 of the pocket patch 22 is folded over the outer spring segment 34 and sewn to the body of the pocket patch. The bottom of the keeper strip 42 is sewn to the vest front 20. The inner spring segment 32 is placed between the vest front 20 and the keeper strip 42. The top of the keeper strip 42 is sewn to the vest front 20. The sides and bottom of the pocket patch are sewn to the vest front, completing the assembly.

While the pocket patch 22 is shown flat, it can be pleated to provide an expanded pocket or shaped in any other desired manner. The spring opener described can be used in pockets other than breast pockets. For instance, in a fishing vest application, the spring opener is used in the left hand side pocket 12 and the right hand side pocket 14. The pockets are enlarged to accommodate fly boxes and no flap is used.

FIG. 7 shows a modification of the pocket seen in FIGS. 1–6. The inner spring segment 32 is positioned between the vest front 20 and the lining (not shown) and retained in this position by a keeper strip 42. The keeper strip is attached to a rear surface of the front of the vest and the keeper strip encloses the inner spring segment 32. The inner spring segment may be left unconnected to the outer spring segment 34. Alternatively, the holes resembling button holes are provided allowing the inner spring segment 32 and the outer spring segment 34 to be connected at their ends 38, 40 as in FIGS. 4 and 5.

Figure 8:
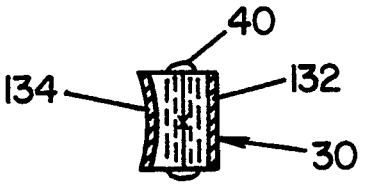
FIG. 8 shows a modified spring element for use in the embodiments of FIGS. 1–7; and, FIG. 9 shows a second modified spring element for use in the embodiments of FIGS. 1–7.
Figure 9:
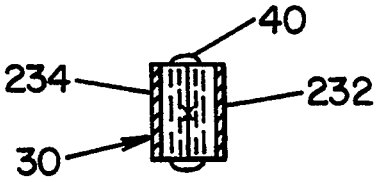

FIGS. 8 and 9 show alternate spring elements 30 for use in the embodiments of FIGS. 1–7. FIG. 8 shows a flat inner spring segment 132 connected to a convex outer spring segment 134. This spring provides snap action in the pocket patch only. FIG. 9 shows a flat inner spring segment 232 and a flat outer spring segment 234. This allows the pocket to more closely follow the contours of the wearer.

The invention has been described with reference to preferred embodiments. Obviously, modifications and alterations will occur to others upon the reading and understanding of the specification. For instance, plastic spring segments can be used. A slotted inner spring segment allowing a sliding connection to the outer spring segment can be used. It is intended to include such modifications and alterations and others insofar as they come within the scope of the appended claims.

Having thus described the invention, it is claimed:

1. A garment adapted to cover a major portion of the trunk of a person, said garment comprising:

a front;

a pocket patch attached to said front to form a pocket between said patch and said front;

pocket closure means comprising an inner flexible lip having a first end and a second end and a length and a width, said inner flexible lip having a convex cross-section through said width and an outer flexible lip having a first end and a second end and a length and a width, said outer flexible lip having a convex cross-section through said width, said first end of said inner lip fastened to said first end of said outer lip and said second end of said inner lip fastened to said second end of said outer lip;

a keeper strip attached to said front, on a rear surface of said front, and enclosing said inner lip between said first and second ends thereof for retaining said inner lip on said front; and foldover means attached to said patch and enclosing said outer lip between said first and second ends thereof for retaining said outer lip on said patch.

2. A garment according to claim 1 in which said foldover means is a unitary part of said pocket patch.

3. A garment according to claim 2 in which the ends of said inner lip and the ends of said outer lip are coated with a resinous material.

4. The garment of claim 3 wherein said first end of said inner lip is fastened to said first end of said outer lip by spot welding and said second end of said inner lip is fastened to said second end of said outer lip by spot welding.

5. A garment according to claim 1 in which said lips are comprised of spring steel.

* * * * *